United States Patent [19]

Shimizu et al.

[11] 4,432,328

[45] Feb. 21, 1984

[54] VAPOR LOCK AND PERCOLATION PHENOMENA INHIBITING SYSTEM

[75] Inventors: Seiichi Shimizu, Higashimurayama; Kouichi Iguchi, Tokyo, both of Japan

[73] Assignee: Nissan Motor Co., Ltd., Yokohama, Japan

[21] Appl. No.: 203,850

[22] Filed: Nov. 4, 1980

[30] Foreign Application Priority Data

Nov. 6, 1979 [JP] Japan ..... 54-142753

[51] Int. Cl.[3] ..... F02M 37/20

[52] U.S. Cl. ..... 123/516; 123/520; 261/DIG. 67

[58] Field of Search ..... 123/516, 517, 520, 518, 123/514; 261/DIG. 67, 72 R

[56] References Cited

U.S. PATENT DOCUMENTS

| | | | |
|---|---|---|---|
| 2,917,110 | 12/1959 | Brohl | 123/516 |
| 3,001,519 | 9/1961 | Dietrich | 123/520 |
| 3,191,587 | 6/1965 | Hall | 261/72 R |
| 3,703,165 | 11/1972 | Hansen | 123/518 |
| 3,778,024 | 12/1973 | Rogerson | 123/520 |
| 3,782,351 | 1/1974 | Rogerson | 123/520 |
| 4,044,743 | 8/1977 | Eaton | 123/520 |
| 4,062,910 | 12/1977 | Rogerson | 261/DIG. 67 |
| 4,195,608 | 4/1980 | Sanada | 123/514 |
| 4,208,997 | 6/1980 | Yoshida | 123/519 |

*Primary Examiner*—Charles J. Myhre
*Assistant Examiner*—Carl Stuart Miller
*Attorney, Agent, or Firm*—Thompson, Birch, Gauthier & Samuels

[57] ABSTRACT

A fuel return passage is provided between the fuel tank and the float chamber of a carburetor and arranged such that when the temperature of fuel upstream of the float chamber is higher than a predetermined value, the heated fuel in which vapor bubbles are contained is forcedly returned via the return passage to the fuel tank thereby preventing the carburetor from being supplied with such heated fuel.

8 Claims, 3 Drawing Figures

VAPOR LOCK AND PERCOLATION PHENOMENA INHIBITING SYSTEM

BACKGROUND OF THE INVENTION

1. Field of the Invention

The present invention relates in general to a system for promoting ready starting of an internal combustion engine, and more particularly to a system for inhibiting vapor lock and percolation phenomena of a fuel supply system of an internal combustion engine.

2. Description of the Prior Art

When the engine stops after high load operation, the air surrounding the fuel supply system of the engine is greatly heated thereby causing the fuel in the fuel supply system to vaporize to form vapor bubbles in the liquid fuel. This sometimes, especially in summer, induces the undesired vapor lock phenomenon and percolation phenomenon which occur at re-starting of the engine. Hitherto, various measures have been proposed for inhibiting such undesired phenomena, but some of them fail to effectively and dependably work.

SUMMARY OF THE INVENTION

According to the present invention, there is provided a vapor lock and percolation phenomena inhibiting system of an engine fuel supply system having a fuel tank and a carburetor with a float chamber in which a float valve is mounted. The inhibiting system comprises a housing having a chamber and first, second and third openings communicating with the chamber, the first opening being connected with said float chamber through the float valve and the second opening being connected with the fuel tank through a fuel supply passage; a fuel return passage leading from the third opening to the fuel tank; an orifice connecting the chamber with the fuel return passage, bypassing the third opening; a valve element movably disposed in the chamber and capable of selectively closing and opening the third opening; a temperature sensor for sensing the temperature of fuel in the chamber; and control means for actuating the valve element to open the third opening when the temperature sensor senses that the fuel in the chamber is higher than a predetermined value, whereby fuel in the chamber is returned via the fuel return passage to the fuel tank when the temperature of the fuel in the chamber is higher than a predetermined value.

It is an essential object of the present invention to provide a vapor lock and percolation phenomena inhibiting system for promoting ready re-starting of an engine.

It is an object of the present invention to provide a vapor lock and percolation phenomena inhibiting system which is constructed such that when the temperature of fuel in the fuel supply system is higher than a predetermined value at re-starting of the engine, a fuel returning passage is formed for returning the heated fuel containing vapor bubbles to the fuel tank, thereby preventing the carburetor from being supplied with such vaporized fuel.

It is still another object of the present invention to provide a vapor lock and percolation phenomena inhibiting system of the above-mentioned construction, which is constructed such that when the fuel amount in the float chamber becomes less than a predetermined amount during the fuel returning to the fuel tank, the fuel returning is inhibited to increase the fuel amount in the float chamber thereby to continue the operation of the engine.

BRIEF DESCRIPTION OF THE DRAWINGS

Other objects and advantages of the present invention will become clear from the following description when taken in conjunction with the accompanying drawings, in which.

DETAILED DESCRIPTION OF THE INVENTION

Figure 1:
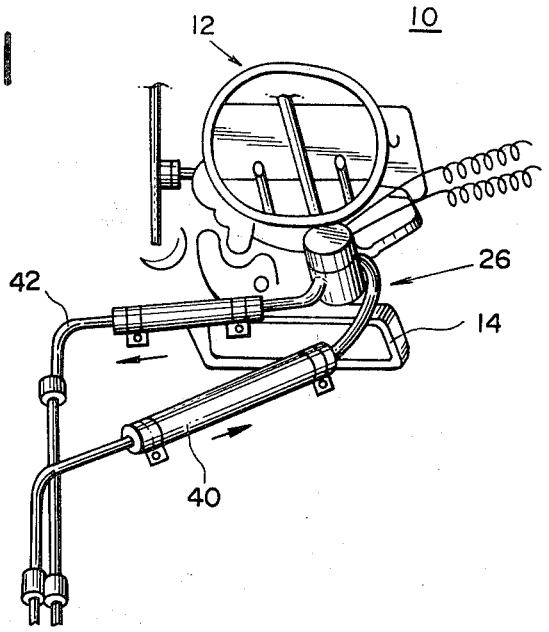
FIG. 1 is a perspective view showing the vapor lock and percolation phenomena inhibiting system of the present invention.
Figure 2:
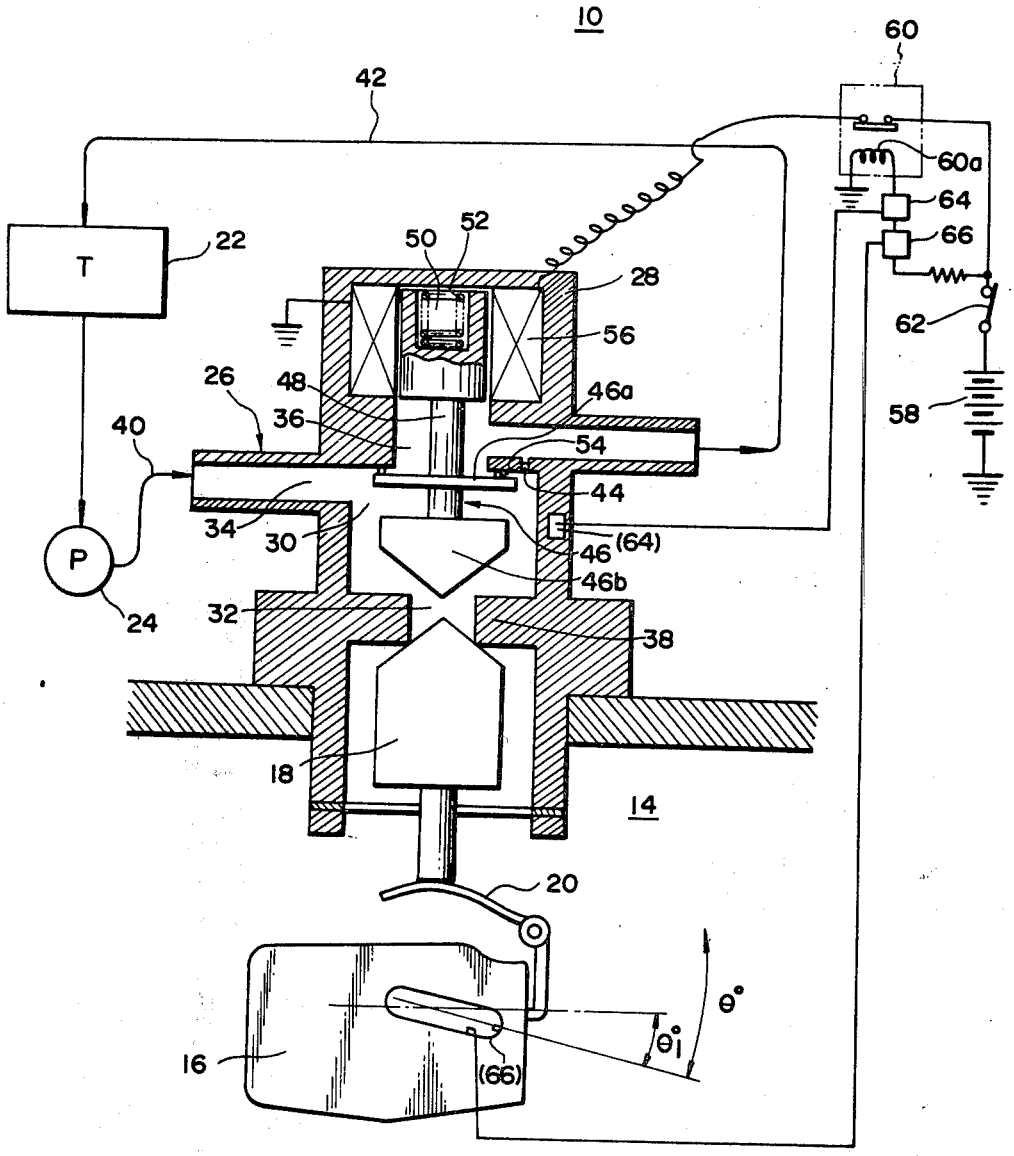
FIG. 2 is a sectional view of a valve unit employed in the system of the present invention, showing the location of the valve unit in a fuel supply system.

Referring to FIGS. 1 and 2, especially FIG. 2, there is illustrated the vapor lock and percolation phenomena inhibiting system 10 in accordance with the present invention. The system 10 is incorporated with a fuel supply system of an engine, such as an internal combustion engine, including a carburetor 12 (see FIG. 1) having a float chamber 14. Within the float chamber 14 is swingably disposed a float 16 to which a float valve element 18 is connected through a pivotable lever 20. As is known, the float 16 is swingable depending on the amount of fuel contained in the float chamber 14 in such a manner that when the amount of fuel in the chamber 14 decreases to a certain amount, it inclines to a level to cause the valve element 18 to open a passage between a fuel tank 22 and the float chamber 14, thereby introducing fuel into the chamber 14. When the amount of fuel in the chamber 14 increases to another certain amount, the float 16 is returned to its horizontal position to cause the valve element 18 to close the passage, thereby stopping the introduction of fuel into the chamber 14. With this, the fuel in the carburetor is maintained at a specified level for correct fuel metering under all operating conditions. Usually, a fuel pump 24 is arranged between the fuel tank 22 and the float chamber 14 for forcedly supplying the fuel in the tank 22 to the chamber 14.

The vapor lock and percolation phenomena inhibiting system 10 comprises a valve unit 26 arranged between the fuel pump 24 and the float chamber 14. The valve unit 26 includes a valve case 28 having a central chamber 30 and first, second and third openings 32, 34 and 36 communicating therewith. As shown, the first and third openings 32 and 36 are located to face each other, and the first opening 32 is formed in a valve seat section 38 with which the above-mentioned valve element 18 of the float chamber 14 is contactable. Preferably, the case for the float valve element 18 and the valve case 28 are united as shown.

The second opening 34 is connected to the fuel pump 24 through a fuel supply line 40, and the third opening 36 is connected to the fuel tank 22 through a fuel return line 42. It should be noted that a narrow orifice 44 is formed between the chamber 30 and the fuel return line 42, bypassing the third opening 36, in a manner as illustrated.

Within the valve case 28 is movably disposed a valve body 46 which has first and second valve elements **46*a* and 46*b* mounted on a common stem 48. One end portion, that is the upper end portion as viewed in FIG. 2, of the stem 48 is enlarged and has a blind bore 50 in which a compression spring 52 is disposed. The first and second valve elements 46***a* and 46*b* of the valve body 46 are constructed to selectively open and close the third and first openings 36 and 32, respectively, of the valve case 28. A seal ring 54 is mounted on the peripheral portion of the third opening 36 to provide assured sealing of the first valve element 46*a* with respect to the third opening 36. It is to be noted that the compression spring 52 urges the valve body 46 to assume a condition wherein the first valve element 46*a* opens the third opening 36 and the second valve element 46*b* closes the first opening 32. For reasons which will become apparent hereinafter, at least the enlarged upper portion of the valve body 46 is constructed of a magnetic material.

A solenoid 56 is stationarily and spacedly disposed about the enlarged upper portion of the valve body 46 in a manner that, upon energization of the solenoid 56, the valve body 46 is shifted in the upward direction, as viewed in FIG. 2, against the force of the spring 52, to assume the position shown in FIG. 2 wherein the first valve element 46*a* closes the third opening 36 and the first opening 32 is open. The solenoid 56 is connected in series to a battery 58 through a relay 60 and an ignition switch 62. The relay 60 is of a normally closed type and has a coil 60*a* having one end grounded and the other end connected in series to the ignition switch 62 through a temperature switch 64 and an inclination switch 66.

The temperature switch 64 is connected to a temperature detecting section positioned in the valve case 28 near the chamber 30, and is designed to close when detecting a temperature higher than or equal to a predetermined value, for example about 65° C., and open when detecting a temperature lower than the predetermined value. The temperature detecting section of the switch 64 may also be located in or on the fuel supply line 40, or on the carburetor (not shown). Bimetal switches and thermocouple switches can be used as the temperature switch 64.

The inclination switch 66 includes a detecting element attached to the float 16 of the float chamber in a manner that when the float 16 inclines to a certain level due to reduction of fuel amount in the float chamber 14, the switch 66 opens, and when the float 16 returns to another certain level due to the increase of fuel amount in the float chamber, the switch 66 closes. As such a switch 66, a conventional mercury switch may be used. Further, a conventional level sensor which directly measures the amount of fuel in the float chamber 14 is also usable in the invention.

The operation of the vapor lock and percolation phenomena inhibiting system 10 of the invention will be described.

In a condition wherein the engine proper operates normally, the system 10 assumes the condition shown in FIG. 2, that is, when the fuel temperature is lower than the predetermined value (which induces the Off-state of the temperature switch 64), and the fuel amount in the float chamber 14 is greater than the certain level (which induces the ON-state of the inclination switch 66), the coil 60*a* of the relay 60 is not energized. Therefore, the relay 60 remains normally closed, providing electric power to energize the solenoid 56 to raise the valve body 46 against the action of the spring 52 to open the first opening 32 to the float chamber 14 and close the third opening 36 to the fuel return line 42. Thus, in this condition, the fuel from the fuel tank 22 is supplied via the fuel supply line 40, the chamber 30 and the first opening 32 into the float chamber 14 in response to the position of the valve element 18. Additionally, a small amount of fuel is returned to the fuel tank 22 through the orifice 44 and the fuel return line 42.

It should be noted that fuel flowing in the fuel return line 42 induces an increase of fuel flow amount in the fuel supply line 40. This prevents the fuel in the fuel supply line 40 from being overheated.

When the engine stops after high load operation, the air surrounding the fuel supply system is greatly heated because the cooling system and fan stop with the engine, causing the fuel in the fuel supply system to be heated and vaporized to form vapor bubbles in the liquid fuel. As is known, formation of such vapor bubbles in the fuel supply system causes the undesired vapor lock phenomenon and percolation phenomenon. However, in the invention, upon re-starting of the engine under such high temperature conditions, the temperature switch takes the ON-state. Thus, the relay 60 takes the OFF-state, causing the OFF-state of the solenoid 52 for the valve body 46 with the result that the valve body 46 closes the first opening 32 to the float chamber and opens the third opening 36 to the fuel return line. Thus, the vapor bubbles contained in the fuel from the fuel tank 22 are returned to the fuel tank through the third opening 36 and the fuel return line 42.

It should be noted that opening the third opening 36 induces the following two advantageous results: (1) a considerable amount of vapor bubbles in the fuel supply line 40 and the fuel chamber 30 is returned to the fuel tank so that the possibility of occurrence of the undesired vapor lock and percolation phenomena decreases, and (2) returning the unwanted vapor bubbles and heated fuel to the fuel tank 22 brings about the introduction of cooled fuel from the fuel tank into the chamber 30.

When the temperature of the fuel in the chamber 30 lowers to the predetermined value, the temperature switch 64 turns OFF, causing the relay 60 to take the ON-state, thereby causing energization of the solenoid 56. This raises the valve body 46 to open the first opening 32 to the float chamber and close the third opening 36 to the fuel return line. The fuel from the fuel tank 22 is supplied to the float chamber 14 in response to the position of the float valve element 18 to maintain the fuel in the float chamber at the specified level. Thus, the engine operation continues.

On the other hand, in a case wherein quick vehicle starting is required just after stopping the engine, when the temperature of the fuel in the fuel chamber 30 does not lower to the predetermined value until the time when the amount of fuel in the float chamber 14 decreases to a level to stop the engine, the following operation takes place.

Upon sensing the fuel shortage in the float chamber 14, the inclination switch 66 turns OFF, thereby causing energization of the solenoid 56 with the result that the valve body 46 raises to open the first opening 32 and close the third opening 36, as shown in FIG. 2. Thus, the fuel from the fuel tank 22 is supplied to the float chamber 14 to continue the operation of the engine. It should be noted that at all times the first opening 32 to the float chamber is closed, the third opening 36 to the fuel return line is open, thereby recycling any heated fuel containing vapor bubbles back to the fuel tank. Thus, the possibility of occurrence of the undesired vapor lock and percolation phenomena lowers.

Figure 3:
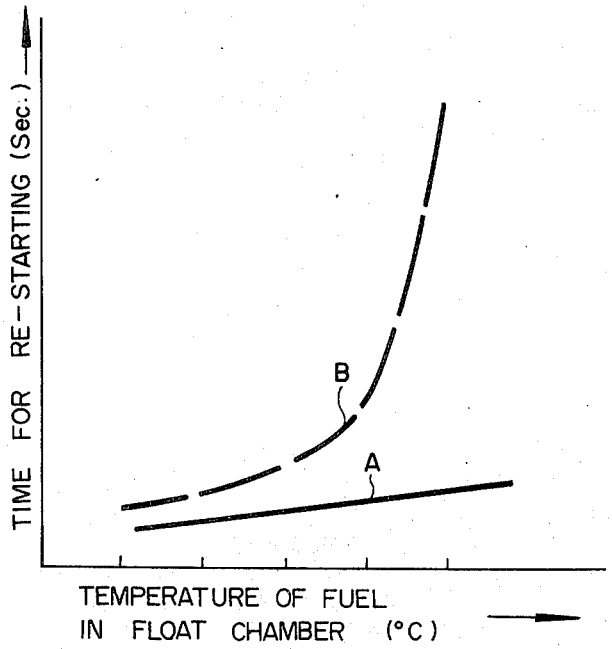
FIG. 3 is a graph comparing the characteristics of the system of the invention and one conventional system.

FIG. 3 is a graph comparing the characteristics of the system of the invention and one conventional system with respect to readiness in re-starting the engine. As is understood from this graph, the system A of the invention shows better results as compared with the conventional one B.

In addition to the above-mentioned construction of the vapor lock and percolation inhibiting system 10, the following modifications are also available in the invention.

The inclination switch 66 may be substituted by a sensor which senses an engine running mode demanding a high fuel consumption. For example, a venturi vacuum responsive switch may be used and arranged such that when the venturi vacuum becomes lower than a predetermined degree due to high power demand of the engine, the switch turns off, thereby permitting the relay 60 to take the ON-state, causing the valve body 46 to open the first opening 22 and close the third opening 36.

The second valve element **46*b* of the valve body 46 may be removed. Thus, in this case, the first opening 32 is always open. However, the fuel returning operation which occurs when the fuel in the fuel chamber 30 is heated contributes to quick normalization of fuel in the fuel chamber 30** by the reason described hereinabove.

From the foregoing description, it will be understood that, in the invention, when the temperature of the fuel in the fuel supply system becomes higher than a predetermined value, the heated fuel in which vapor bubbles are formed is forcedly returned to the fuel tank thereby preventing such vapor bubbles contained in the heated fuel from being supplied to the carburetor. Thus, the undesired vapor lock and percolation phenomena originating from the presence of such vapor bubbles do not occur. Further, since the recirculation of fuel brings about the introduction of cooled fuel from the fuel tank into the fuel supply system, the undesired phenomena inhibition is assured. Furthermore, in the invention, when the fuel amount in the float chamber becomes less than a predetermined amount, the fuel returning to the fuel tank is inhibited to increase the fuel amount in the float chamber to continue the operation of the engine.

What is claimed is:

1. A vapor lock and percolation phenomenon inhibiting system of an engine fuel supply system having a fuel tank and a carburetor with a float chamber, comprising:

a housing having a chamber and first, second and third openings communicating with said chamber, said first opening being connected with said float chamber, said second opening being connected with said fule tank through a fuel supply passage;

a fuel return passage leading from said third opening to said fuel tank;

an orifice connecting said chamber with said fuel return passage, bypassing said third opening;

a valve element capable of selectively closing and opening said third opening, said valve element being constructed to open said first opening when closing said third opening and to close said first opening when opening said third opening, said valve element including separate first and second valve element sections, said first valve element section functioning to open and close said third opening, and said second valve element section functioning to open and close said first opening;

a temperature sensor for sensing the temperature of fuel in said chamber; and control means for actuating said valve element to open said third opening when the temperature sensor senses that the temperature of the fuel in the chamber is higher than a predetermined value.

2. A vapor lock and percolation phenomena inhibiting system of an engine fuel supply system having a fuel tank and a carburetor with a float chamber, comprising:

a housing having a chamber and first, second and third openings communicating with said chamber, said first opening being connected with said float chamber, said second opening being connected with said fuel tank through a fuel supply passage;

a fuel return passage leading from said third opening to said fuel tank;

an orifice connecting said chamber with said fuel return passage, bypassing said third opening;

a valve element capable of selectively closing and opening said third opening;

a temperature sensor for sensing the temperature of fuel in said chamber; and control means for actuating said valve element to open said third opening when the temperature sensor senses that the temperature of the fuel in the chamber is higher than a predetermined value.

3. A vapor lock and percolation phenomena inhibiting system as claimed in claim 2, in which said valve element is constructed to open said first opening when closing said third opening and to close said first opening when opening said third opening.

4. A vapor lock and percolation phenomena inhibiting system as claimed in claim 3, further comprising a float level detecting means for preventing said valve element from closing said first opening when the amount of fuel in said float chamber is less than a predetermined amount.

5. A vapor lock and percolation phenomena inhibiting system as clamed in claim 2, in which said first opening is always open.

6. A vapor lock and percolation phenomena inhibiting system as claimed in claim 5, further comprising a float level detecting means for preventing said valve element from opening said third opening when the amount of fuel in said float chamber is less than a predetermined amount.

7. A vapor lock and percolation phenomena inhibiting system as claimed in claim 2, in which said orifice is formed in said housing to provide a restricted communication between said chamber and said fuel return passage downstream of said third opening.

8. A vapor lock and percolation phenomena inhibiting system as claimed in claim 2, in which said valve element is biased to move in a direction to open said third opening by a compression spring, and in which a stem portion of said valve element is spacedly surrounded by a solenoid secured to said housing, said solenoid attracting said stem portion against the force of said compression spring to cause said valve element to close said third opening when electrically energized.

* * * * *